US011245202B2

(12) United States Patent
Chen et al.

(10) Patent No.: US 11,245,202 B2
(45) Date of Patent: Feb. 8, 2022

(54) MILLIMETER WAVE ARRAY ANTENNA AND MOBILE TERMINAL

(71) Applicant: AAC Technologies Pte. Ltd., Singapore (SG)

(72) Inventors: Yongli Chen, Shenzhen (CN); Xinying Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 72 days.

(21) Appl. No.: 16/703,798

(22) Filed: Dec. 4, 2019

(65) Prior Publication Data

US 2020/0212596 A1 Jul. 2, 2020

(30) Foreign Application Priority Data

Dec. 28, 2018 (CN) ..... 201811628344.1

(51) Int. Cl.
*H01Q 21/06* (2006.01)
*H01Q 21/00* (2006.01)
(Continued)

(52) U.S. Cl.
CPC ..... *H01Q 21/065* (2013.01); *H01Q 1/24* (2013.01); *H01Q 1/48* (2013.01); *H01Q 5/10* (2015.01);
(Continued)

(58) Field of Classification Search
CPC .... H01Q 21/065; H01Q 21/0006; H01Q 1/24; H01Q 5/10; H01Q 1/48; H01Q 21/00; H01Q 21/06
(Continued)

(56) References Cited

U.S. PATENT DOCUMENTS 5,995,047 A * 11/1999 Freyssinier ..... H01Q 1/38 343/700 MS
6,496,157 B1 * 12/2002 Mottier ..... H01Q 1/246 342/373
(Continued)

FOREIGN PATENT DOCUMENTS

CN 108899644 A1 11/2018
CN 208173791 B1 11/2018
WO 2010028491 A1 3/2010

OTHER PUBLICATIONS

1st Office Action dated Apr. 20, 2020 by SIPO in related Chinese Patent Application No. 201811628344.1 (10 Pages).
(Continued)

*Primary Examiner* — Hai V Tran
(74) *Attorney, Agent, or Firm* — W&G Law Group

(57) ABSTRACT

The present invention provides a millimeter wave array antenna and mobile terminal. The millimeter wave array antenna includes several antenna elements arranged in an array, each antenna element includes a first radiation patch, a second radiation patch, a first grounding plate, a power divider layer and a second grounding plate sequentially stacked from top to bottom. The first radiating patch is spaced apart from and coupled to the second radiating patch. The second radiating patch is provided with two feeding ends, and each feeding end is provided with two feeding notches. The power divider layer includes two transmission lines, each includes one input port and two phase-inverted output ports electrically connected to the input port. The two phase-inverted output ports are respectively coupling-fed two feeding notches of one feeding end. Each antenna element generates orthogonal polarization and dual-band resonance under excitation of two input ports.

14 Claims, 5 Drawing Sheets

(51) Int. Cl.

| | |
|---|---|
| ***H01Q 1/24*** | (2006.01) |
| ***H01Q 5/10*** | (2015.01) |
| ***H01Q 1/48*** | (2006.01) |
| ***H01Q 5/50*** | (2015.01) |

(52) U.S. Cl.
CPC ..... *H01Q 5/50* (2015.01); *H01Q 21/00* (2013.01); *H01Q 21/0006* (2013.01); *H01Q 21/06* (2013.01)

(58) Field of Classification Search
USPC ..... 343/845
See application file for complete search history.

(56) References Cited

U.S. PATENT DOCUMENTS 8,803,757 B2 * 8/2014 Shen ..... H01Q 9/0435 343/857
9,379,434 B2 * 6/2016 Sato ..... H01Q 1/525
9,755,306 B1 * 9/2017 Ogilvie ..... H01Q 9/0414
2010/0177012 A1 * 7/2010 Morrow ..... H01Q 21/0025 343/893
2011/0025574 A1 * 2/2011 Tiezzi ..... H01Q 21/065 343/824
2016/0126617 A1 * 5/2016 Jan ..... H01Q 9/0414 343/848

OTHER PUBLICATIONS

2nd Office Action dated Nov. 17, 2020 by SIPO in related Chinese Patent Application No. 201811628344.1 (9 Pages).
PCT search report dated Jan. 23, 2020 by SIPO in related PCT Patent Application No. PCT/CN2019/113326 (8 Pages).

* cited by examiner

MILLIMETER WAVE ARRAY ANTENNA AND MOBILE TERMINAL

TECHNICAL FIELD

The present disclosure relates to the technical field of antenna structures for mobile terminals, and in particular, to a millimeter wave array antenna and a mobile terminal.

BACKGROUND

In order to meet the development of future communication industry, researches have been made on 5G millimeter wave array antennas for handheld devices. In order to obtain better performance, high gain, low side lobes and wide band, miniaturized array antennas are the goal we pursue. Among them, there is a certain difficulty in designing a dual-band dual-polarized array for a terminal.

At present, researches on an array implementing both dual-band and dual-polarization are few in the field of millimeter wave band. The bandwidth covered by both 28 GHz and 39 GHz is narrow, cross-polarization generated by dual polarization is relatively poor; and the volume is a not ideal to some extent.

DETAILED DESCRIPTION

The present disclosure will now be described in detail in conjunction with FIGS. 1-8.

Figure 1:
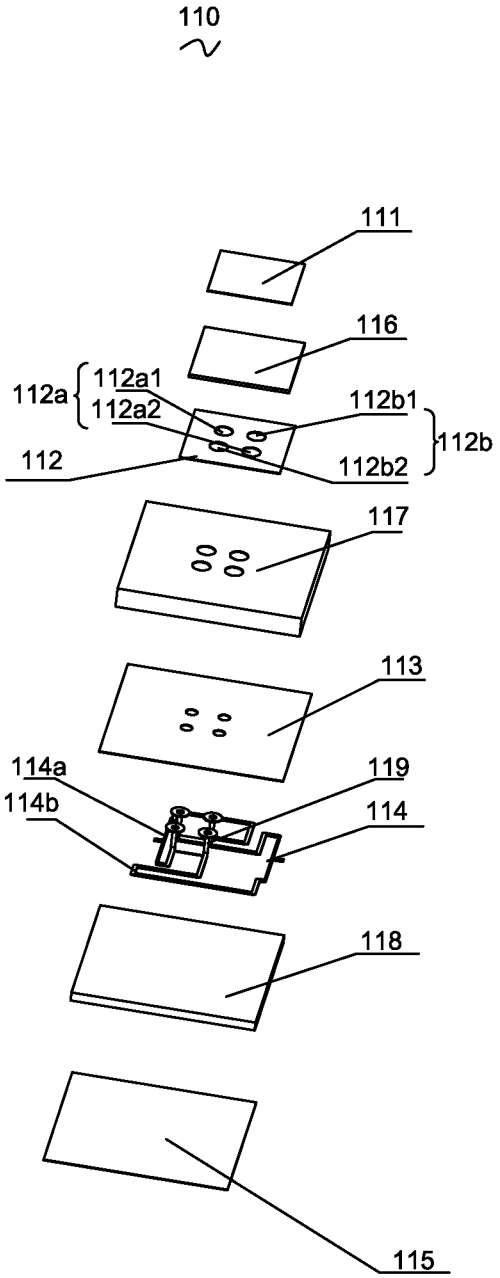
FIG. 1 is a perspective exploded view of an antenna element in a millimeter wave array antenna according to the present disclosure.
Figure 2:
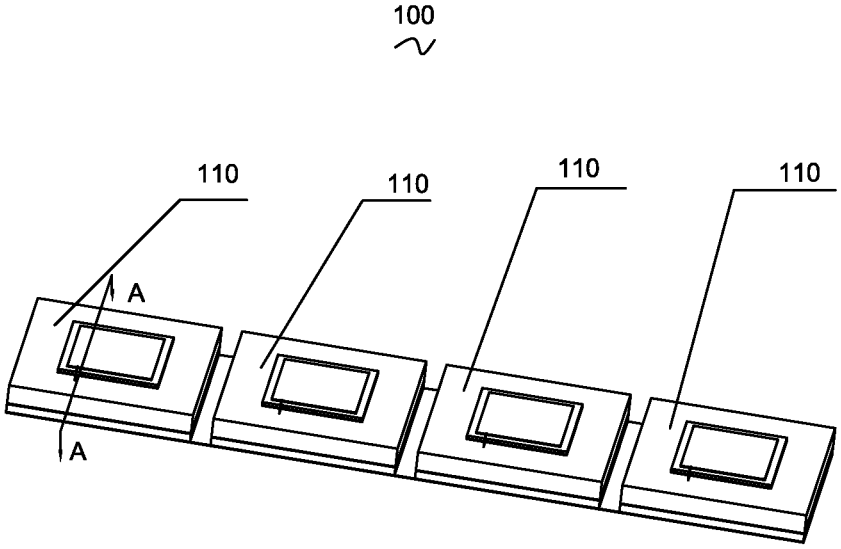
FIG. 2 is a schematic structural view of a millimeter wave array antenna according to the present disclosure.
Figure 3:
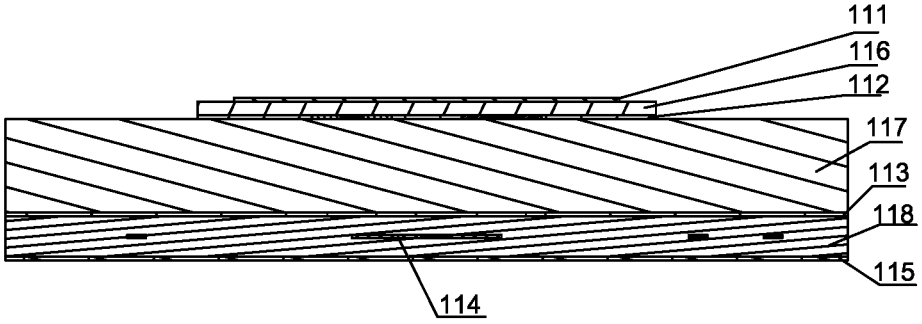
FIG. 3 is a cross-sectional view of the millimeter wave array antenna shown in FIG. 2 taken along line AA.

A first aspect of the present disclosure relates to a millimeter wave array antenna for a mobile terminal. The mobile terminal may be, for example, a mobile phone, a computer or a tablet. As shown in FIG. 1 and FIG. 2, the millimeter wave array antenna 100 includes several antenna elements 110 arranged in an array, each of the antenna elements 110 includes a first radiation patch 111, a second radiating patch 112, a first grounding plate 113, a power divider layer 114, and a second grounding plate 115 stacked sequentially from top to bottom. The first radiating patch 111 is spaced apart from and coupled to the second radiating patch 112. The second radiating patch 112 is provided with two feeding ends 112*a*, 112*b*, the feeding end 112*a* is provided with two feeding notches 112*a*1, 112*a*2, and the feeding end 112*b* is provided with two feeding notches 112*b*1, 112*b*2. The power divider layer 114 includes two transmission lines 114*a*, 114*b*. The transmission line 114*a* includes one input port IN1 and two phase-inverted output ports OUT1, OUT2 electrically connected to the input port IN1. The transmission line 114*b* includes one input port IN2 and two phase-inverted output ports OUT3, OUT4 electrically connected to the input port IN2. The phase-inverted output ports OUT1, OUT2 are respectively coupling-fed the two feeding notches 112*b*1, 112*b*2 of the feeding end 112*b*, and the phase-inverted output ports OUT3, OUT4 are respectively coupling-fed the two feeding notches 112*a*1, 112*a*2 of the feeding ends 112*a*. Each of the antenna elements 110 generates orthogonal polarization and dual-band resonance under excitation of the two input ports IN1, IN2.

The antenna element 110 of the embodiment has a double-layer radiating patch, which includes a first radiating patch 111 and a second radiating patch 112. The first radiating patch 111 is spaced apart from and coupled to the second radiating patch 112. In this way, the dual-band coverage of the millimeter wave band may be realized without enlarging the structure of the millimeter wave array antenna 100 thereby improving the dual-band bandwidth. Moreover, coupling with and feeding to the two feeding notches 112*a*1, 112*a*2 of the feed end 112*a* may be achieved by means of the provided power divider layer 114. Each of the antenna elements 110 generates orthogonal polarization and dual-band resonance under excitation of the two input ports IN1, IN2.

It should be noted that there is no limitation on how to realize the structure in which the first radiation patch 111 is spaced apart from and coupled to the second radiating patch 112. For example, a dielectric slab or a structure similar to the dielectric slab may be arranged between the first radiation patch 111 and the second radiation patch 112, etc.

Figure 4:
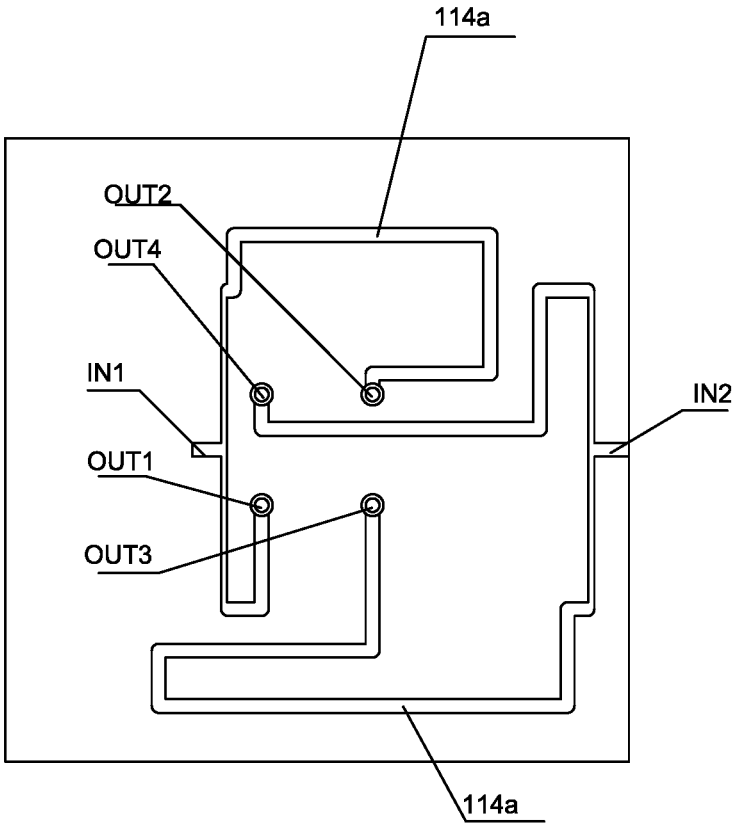
FIG. 4 is a schematic structural view of a phase-inverted power divider in a millimeter wave array antenna according to the present disclosure.
Figure 5:
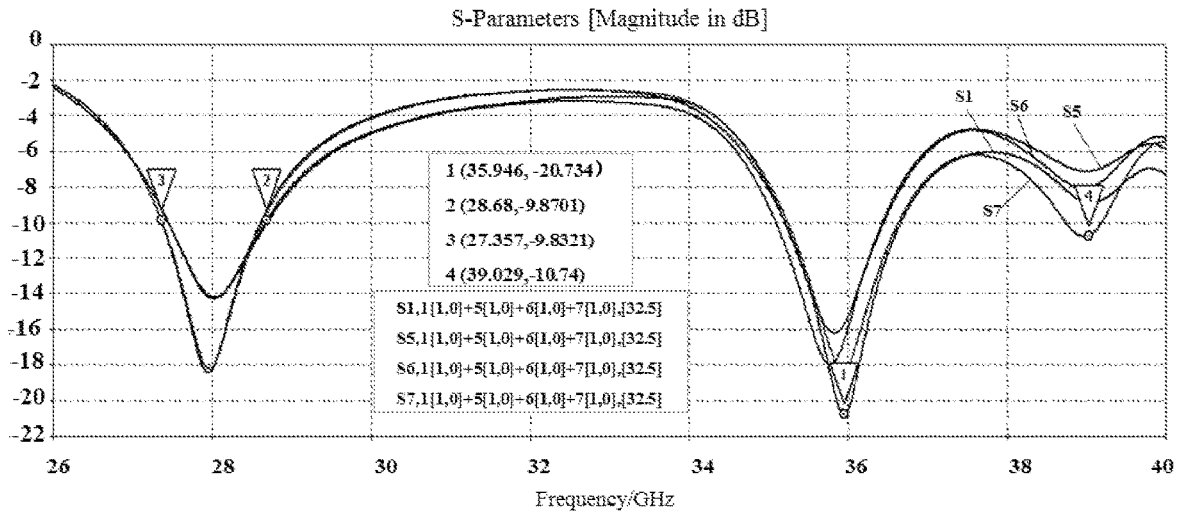
FIG. 5 is a graph illustrating a reflection coefficient curve of a first polarization input port of respective antenna elements in the millimeter wave array antenna according to the present disclosure.
Figure 6:
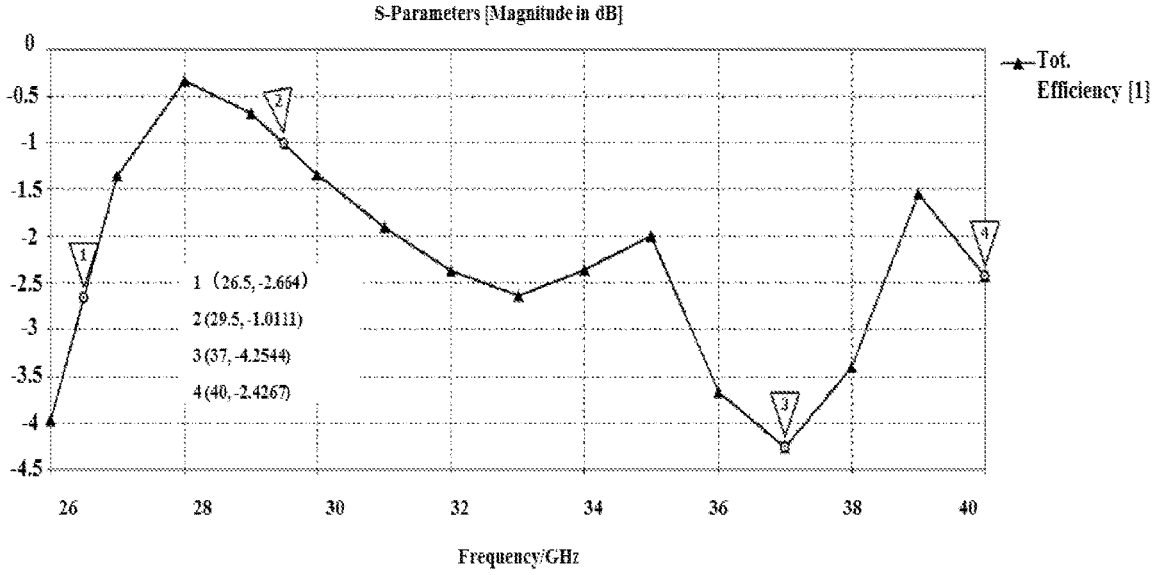
FIG. 6 is a graph illustrating an efficiency curve of a first polarization of one of the antenna elements in the millimeter wave array antenna according to the present disclosure.
Figure 7:
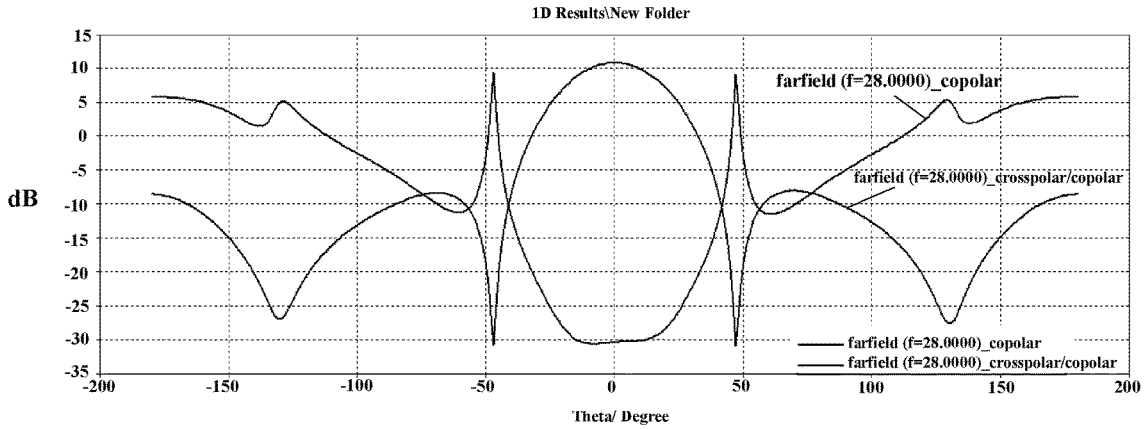
FIG. 7 is a diagram illustrating a direction of one of the antenna elements in the millimeter wave array antenna according to the present disclosure at 28 GHz.
Figure 8:
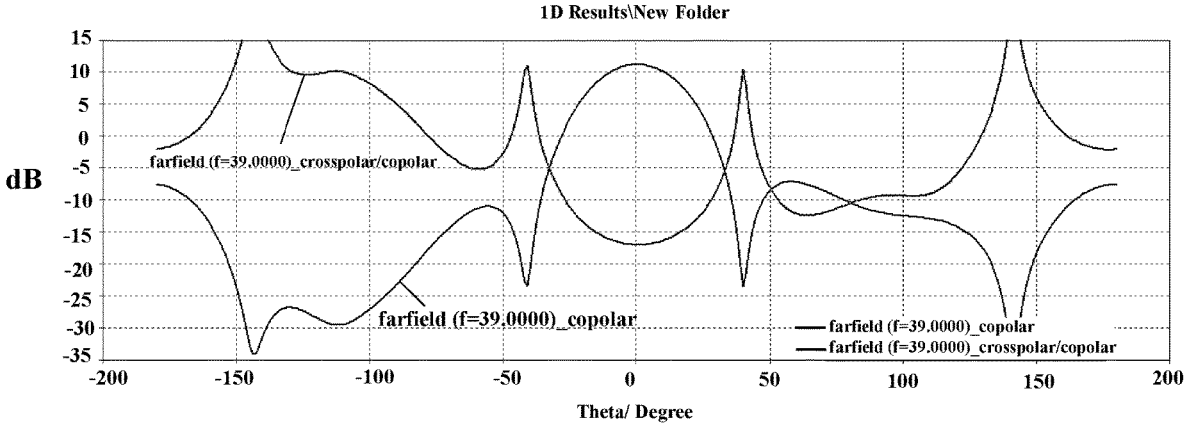
FIG. 8 is a diagram illustrating a direction of one of the antenna elements in the millimeter wave array antenna according to the present disclosure at 39 GHz.

Specifically, as shown in FIG. 1 and FIG. 4, the antenna element 110 further includes a first dielectric slab 116 sandwiched between the first radiating patch 111 and the second radiating patch 112, a second dielectric slab 117 sandwiched between the second radiating patch 112 and the first grounding plate 113, and a third dielectric slab 118 sandwiched between the first grounding plate 113 and the second grounding plate 115. The power divider layer 114 is disposed within the third dielectric slab 118 and spaced apart from the first grounding plate 113 and the second grounding plate 115.

In order to improve the communication performance of the millimeter wave array antenna 100, dielectric constants of the first dielectric slab 116, the second dielectric slab 117 and the third dielectric slab 118 may range from 2 to 4. Of course, in practical application, those skilled in the art may also select other values for dielectric constants according to practical requirements.

In order to improve the communication performance of the millimeter wave array antenna 100, loss angle tangent values of the first dielectric slab 116, the second dielectric slab 117 and the third dielectric slab 118 may range from 0.0005 to 0.0015. Of course, in practical application, those skilled in the art may also select other values for the loss angle tangent value according to practical requirements.

As shown in FIG. 1, the antenna element 110 further includes four probes 119 extending from the phase-inverted output ports OUT1, OUT2, OUT3, OUT4 of the power divider layer 114 toward the second radiating patch 112. One end of each of the probes 119 facing away from the power divider layer 114 is received within one of the feeding notches 112*a*1, 112*a*2, 112*b*1, 112*b*2 and is coupling-fed the second radiation patch 112.

As shown in FIGS. 1 and 2, the millimeter wave array antenna 100 includes four antenna elements 110, and the four antenna elements 110 are arranged in a 1*4 array. Of course, in practical application, those skilled in the art may also design a millimeter wave array antenna having more antenna elements 110, and the arrangement manner of respective antenna elements 110 may also be determined according to practical requirements.

As shown in FIG. 1, the first radiation patch 111 and the second radiation patch 112 may each have a square structure. As shown in FIG. 1, the two feeding notches 112*a*1, 112*a*2 of the feeding end 112*a* are located on one diagonal line of the second radiating patch 112, and the two feeding notches 112*b*1, 112*b*2 of the feeding end 112*b* are located on the other diagonal line.

As shown in FIG. 1, the first radiation patch 111 is smaller in size than the second radiation patch 112 and an orthographic projection of the first radiation patch 111 to a plane where the second radiation patch 112 is located falls within the second radiation patch 112.

In order to make the structure of the millimeter wave array antenna 100 more compact and reduce the manufacturing cost of the millimeter wave array antenna 100, the second grounding plates 115 of respective antenna elements 110 may be integrally formed.

In the millimeter wave array antenna 100 of the present disclosure, a dual-band coverage of the millimeter wave band may be realized, thereby enhancing the dual-band bandwidth without enlarging the structure of the millimeter wave array antenna 100. Moreover, it is also possible to generate a zero point on the main lobe means of the provided power divider layers 114, thereby increasing the cross polarization ratio, as shown with reference to FIGS. 5 to 8.

A second aspect of the present disclosure provides a mobile terminal which includes the millimeter wave array antenna 100 described above.

The mobile terminal of the present embodiment includes the millimeter wave array antenna 100 described above. The millimeter wave array antenna 100 includes a double-layer radiation patch, the double-layer radiation patch comprises a first radiation patch 111 and a second radiation patch 112, and the first radiation patch 111 is spaced apart from and coupled to and the second radiation patch 112, so that a dual-band coverage for the millimeter wave band may be realized without enlarging the structure of the millimeter wave array antenna 100, thereby increasing the dual-band bandwidth. Moreover, it is also possible to use the provided power divider layers 114, which includes two transmission lines 114*a*, 114*b*, where, the transmission line 114*a* includes an input port IN1 and two phase-inverted output ports OUT1, OUT2 electrically connected with the input port IN1, and the transmission line 114*b* includes an input port IN2 and two phase-inverted output ports OUT3, OUT4 electrically connected with the input port IN2. The phase-inverted output ports OUT1, OUT2 are respectively coupling-fed the two feeding notches 112*b*1, 112*b*2 of the feeding end 112*b*, and the phase-inverted output ports OUT3, OUT4 are respectively coupling-fed the two feeding notches 112*a*1, 112*a*2 of the feeding ends 112*a*. Each of the antenna elements 110 generates orthogonal polarization and dual-band resonance under excitation of the two input ports IN1, IN2.

The above only describes embodiments of the present disclosure, and it should be noted that those skilled in the art may make improvements to the embodiments without departing from the inventive concept, which all fall within the protection scope of the present disclosure.

What is claimed is:

1. A millimeter wave array antenna, comprising several antenna elements arranged in an array, wherein, each of the antenna elements comprises a first radiation patch, a second radiation patch, a first grounding plate, a power divider layer and a second grounding plate stacked sequentially from top to bottom; wherein, the first radiation patch is spaced apart from and coupled to the second radiation patch, the second radiation patch is provided with two feeding ends, each of the feeding ends is provided with two feeding notches, and the power divider layer comprises two transmission lines, wherein, each of the transmission lines comprises one input port and two phase-inverted output ports electrically connected to the input port, the two phase-inverted output ports are respectively coupling-fed the two feeding notches of one of the feeding ends, and each of the antenna elements generates orthogonal polarization and dual-band resonance under excitation of two input ports, wherein the antenna element further comprises a first dielectric slab sandwiched between the first radiation patch and the second radiation patch, a second dielectric slab sandwiched between the second radiating patch and the first grounding plate, and a third dielectric slab sandwiched between the first grounding plate and the second grounding plate, wherein, the power divider layer is disposed within the third dielectric slab and spaced apart from the first grounding plate and the second grounding plate.

2. The millimeter wave array antenna according to claim 1, wherein the antenna element further comprises four probes extending from the phase-inverted output ports of the power divider layer toward the second radiation patch, wherein, one end of each of the probes facing away from the power divider layer is received within one of the feeding notches and coupling-fed the second radiation patch.

3. The millimeter wave array antenna according to claim 2, wherein the first radiation patch and the second radiation patch each have a square structure.

4. The millimeter wave array antenna according to claim 3, wherein the two feeding notches of one of the feeding ends are located on one diagonal line of the second radiation patch, and the two feeding notches of the other feeding end are located on the other diagonal line of the second radiating patch.

5. The millimeter wave array antenna according to claim 1, wherein the millimeter wave array antenna comprises four antenna elements, and the four antenna elements are arranged in a 1*4 array.

6. The millimeter wave array antenna according to claim 1, wherein a size of the first radiation patch is smaller than that of the second radiation patch, and an orthographic projection of the first radiation patch to a surface where the second radiation patch is located falls within the second radiation patch.

7. The millimeter wave array antenna according to claim 1, wherein the second grounding plates of respective antenna elements are integrally formed.

8. A mobile terminal comprising a millimeter wave array antenna, the millimeter wave array antenna comprising several antenna elements arranged in an array, wherein, each of the antenna elements comprises a first radiation patch, a second radiation patch, a first grounding plate, a power divider layer and a second grounding plate stacked sequentially from top to bottom; wherein, the first radiation patch is spaced apart from and coupled to the second radiation patch, the second radiation patch is provided with two feeding ends, each of the feeding ends is provided with two feeding notches, and the power divider layer comprises two transmission lines, wherein, each of the transmission lines comprises one input port and two phase-inverted output ports electrically connected to the input port, the two phase-inverted output ports are respectively coupling-fed the two feeding notches of one of the feeding ends, and each of the antenna elements generates orthogonal polarization and dual-band resonance under excitation of two input ports, wherein the antenna element further comprises a first dielectric slab sandwiched between the first radiation patch and the second radiation patch, a second dielectric slab sandwiched between the second radiating patch and the first grounding plate, and a third dielectric slab sandwiched between the first grounding plate and the second grounding plate, wherein, the power divider layer is disposed within the third dielectric slab and spaced apart from the first grounding plate and the second grounding plate.

9. The mobile terminal according to claim 8, wherein the antenna element further comprises four probes extending from the phase-inverted output ports of the power divider layer toward the second radiation patch, wherein, one end of each of the probes facing away from the power divider layer is received within one of the feeding notches and coupling-fed the second radiation patch.

10. The mobile terminal according to claim 9, wherein the first radiation patch and the second radiation patch each have a square structure.

11. The mobile terminal according to claim 10, wherein the two feeding notches of one of the feeding ends are located on one diagonal line of the second radiation patch, and the two feeding notches of the other feeding end are located on the other diagonal line of the second radiating patch.

12. The mobile terminal according to claim 8, wherein the millimeter wave array antenna comprises four antenna elements, and the four antenna elements are arranged in a 1*4 array.

13. The mobile terminal according to claim 8, wherein a size of the first radiation patch is smaller than that of the second radiation patch, and an orthographic projection of the first radiation patch to a surface where the second radiation patch is located falls within the second radiation patch.

14. The mobile terminal according to claim 8, wherein the second grounding plates of respective antenna elements are integrally formed.

* * * * *